US005992132A

United States Patent [19]

Auerbach

[11] Patent Number: 5,992,132

[45] Date of Patent: Nov. 30, 1999

[54] ROTATING ENVELOPE INSERTION HORN

[75] Inventor: David R. Auerbach, West Redding, Conn.

[73] Assignee: Pitney Bowes Inc., Stamford, Conn.

[21] Appl. No.: 09/001,758

[22] Filed: Dec. 31, 1997

[51] Int. Cl.[6] ..... B65B 43/34

[52] U.S. Cl. ..... 53/569; 53/255; 53/381.5; 493/259; 493/309

[58] Field of Search ..... 53/381.5, 381.6, 53/569, 255, 261, 572; 493/259, 258, 257, 309

[56] References Cited

U.S. PATENT DOCUMENTS 5,168,689 12/1992 Macelis ..... 53/381.5 X
5,247,780 9/1993 Kulpa et al. ..... 53/569 X
5,660,030 8/1997 Auerbach et al. ..... 53/381.5 X

*Primary Examiner*—James F. Coan
*Attorney, Agent, or Firm*—Christopher J. Capelli; Melvin J. Scolnick

[57] ABSTRACT

A rotatable insertion horn for opening an envelope prior to insertion of documents into the envelope. The insertion horn includes a planar bottom plate having an upstream end, a downstream end and first and second side portions. A side wall is provided that extends upward from the first side portion of the planar bottom plate. The side wall has a downstream end adjacent to the downstream end of the planar bottom plate and an upstream end adjacent to the upstream end of the planar bottom plate wherein a portion of the planar bottom plate extends downstream from the downstream end of the side wall. A top planar plate is provided that extends from the top of the side wall and towards the second side of the bottom plate wherein the top plate is superposed and substantially parallel to the bottom plate.

16 Claims, 6 Drawing Sheets

ROTATING ENVELOPE INSERTION HORN

FIELD OF THE INVENTION

The present invention relates generally to multi-station document inserting systems, which assemble batches of documents for insertion into envelopes. More particularly, the present invention is directed toward an envelope feeder-insert station having a rotatable insertion horn for opening an envelope prior to insertion of documents into the envelope.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8, 9 and 14 series inserter systems available from Pitney Bowes, Inc., Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation. For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to the burster-folder station for separating and folding. A control scanner located in the burster-folder station senses the control marks on the control documents. Thereafter, the serially arranged insert feeder stations sequentially feed the necessary documents onto a transport deck at each station as the control document arrives at the respective station to form a precisely collated stack of documents which is transported to the envelope feeder-insert station where the stack is inserted into the envelope. The transport deck preferably includes a ramp feed so that the control documents always remain on top of the stack of advancing documents. A typical modern inserter system also includes a control system to synchronize the operation of the overall inserter system to ensure that the collations are properly assembled.

In regards to the envelope feeder-insert station, they are critical to the operation of document inserting systems. Typically, such an envelope insert device inserts collated enclosures into a waiting envelope. Envelope inserting machines are used in a wide range of enclosure thickness' and also with enclosures which are not significantly different in length than the length of the envelopes into which they are inserted. The difference between the length of the enclosures and the envelope should be minimized so that the addressing information printed on the enclosure which is intended to appear in the envelope window does not shift in position and become hidden.

Insertion horns for opening an envelope are known which rotate into the envelope after the envelope has been properly located. However, conventional, rotating insertion horns typically require operator intervention in order to accommodate a range of enclosure thickness' and envelope depths. Obviously, operator intervention is costly in terms of down time of the inserter and the effort required on the part of the operator.

In an attempt to overcome the foregoing shortcomings, commonly assigned U.S. Pat. No. 5,247,780 to Kulpa et al. sets forth rotating insertion horns which open an envelope and are so shaped that they can accommodate a range of envelope depths and enclosure thicknesses. These insertion horns operate without the need for an operator to intervene to adjust any of the inserter apparatus. But, a drawback associated with these insertion horns is that the shape of the inserting portion of the horn requires that the envelope be opened prior to rotating the horn into the envelope and thus is unable to assist in the initial opening of the envelope. Hence, in addition to the opening horns, another mechanism was required in the insertion device for opening the envelopes prior to the insertion of the opening horns. Obviously this additional opening mechanism added to the overall complexity and cost of the insertion device.

Therefore it is an object of the present invention to overcome the difficulties associated with insertion horns that facilitate the insertion of documents into an envelope.

SUMMARY OF THE INVENTION

Accordingly, the instant invention provides a rotatable insertion horn for opening an envelope prior to insertion of documents into the envelope without the need for additional mechanisms. The insertion horn includes a planar bottom plate having an upstream end, a downstream end and first and second side portions. A side wall is provided that extends upward from the first side portion of the planar bottom plate. The side wall has a downstream end adjacent to the downstream end of the planar bottom plate and an upstream end adjacent to the upstream end of the planar bottom plate wherein a portion of the planar bottom plate extends downstream from the downstream end of the side wall. This portion of the bottom plate is termed a "stripper blade" because of its ability to enter into the open end of an envelope in which the envelopes back panel is resting against the envelopes front panel. Hence, when the "stripper blade" portion is caused to enter into the open end of an envelope it is operative to strip the envelopes back panel away from its front panel, thus providing a channel in the open end of the envelope for insertion thereinto.

A top planar plate is also provided that extends from a top wall of the side wall and towards the second side of the bottom plate wherein the top plate is superposed and substantially parallel to the bottom plate.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
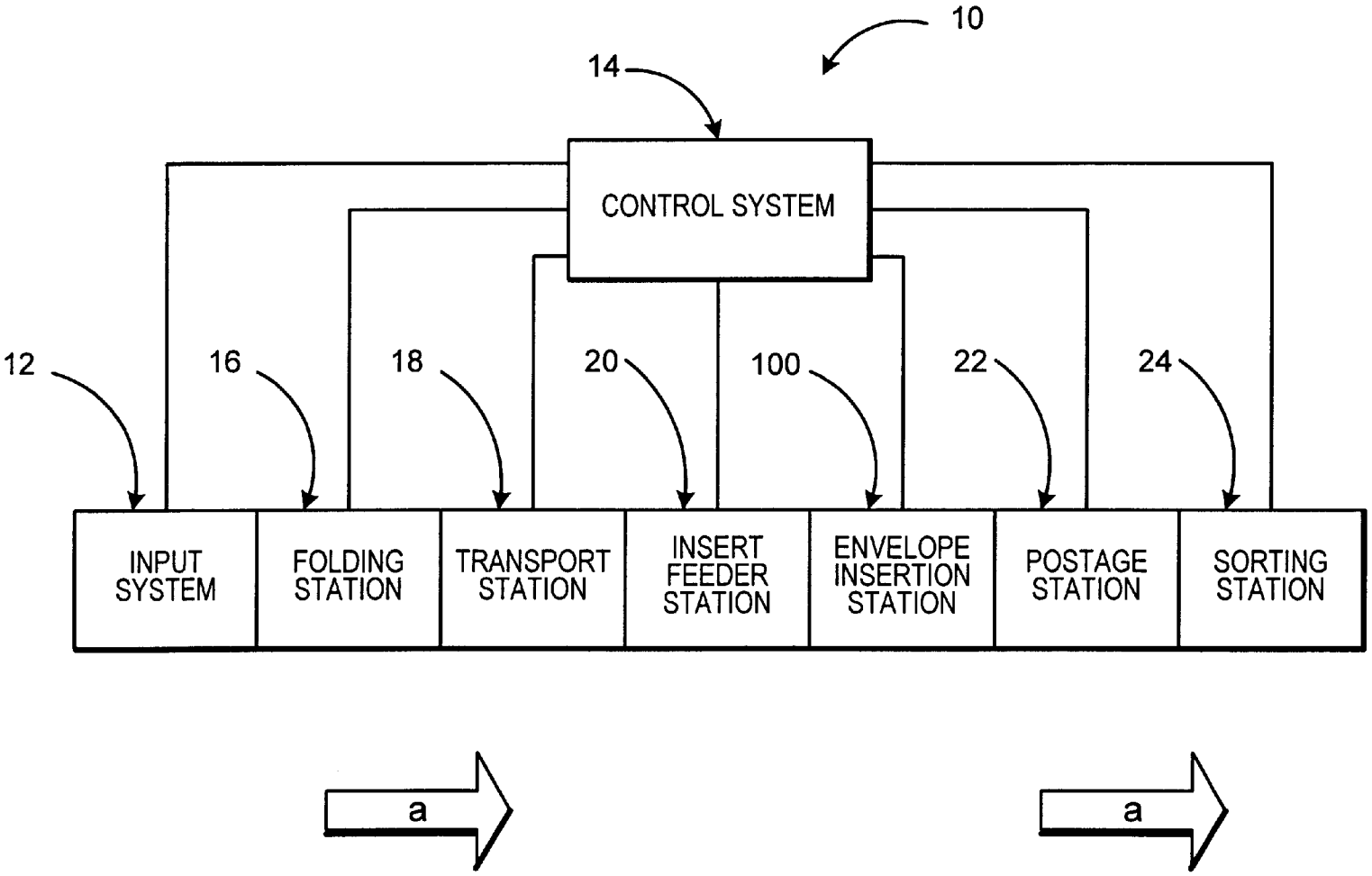
FIG. 1 is a block diagram schematic of a document inserting system in which the present invention input system is incorporated.

In describing the preferred embodiment of the present invention, reference is made to the drawings, wherein there is seen in FIG. 1 a schematic of a typical document inserting system, generally designated 10, which implements the present invention insertion station 100. In the following description, numerous paper handling stations implemented in inserter system 10 are set forth to provide a thorough understanding of the operating environment of the present invention. However it will become apparent to one skilled in the art that the present invention may be practiced without the specific details in regards to each of these paper-handling stations.

As will be described in greater detail below, system 10 preferably includes an input system 12 that feeds paper sheets from a paper web to an accumulating station that accumulates the sheets of paper in collation packets. Preferably, only a single sheet of a collation is coded (the control document), which coded information enables the control system 14 of inserter system 10 to control the processing of documents in the various stations of the mass mailing inserter system. The code can comprise a bar code, UPC code or the like.

Essentially, input system 12 feeds sheets in a paper path, as indicated by arrow "a," along what is commonly termed the "main deck" of inserter system 10. After sheets are accumulated into collations by input system 12, the collations are folded in folding station 16 and the folded collations are then conveyed to a transport station 18, preferably operative to perform buffering operations for maintaining a proper timing scheme for the processing of documents in inserting system 10.

Each sheet collation is fed from transport station 18 to insert feeder station 20. It is to be appreciated that a typical inserter system 10 includes a plurality of feeder stations, but for clarity of illustration only a single insert feeder 20 is shown. Insert feeder station 20 is operational to convey an insert (e.g., an advertisement) from a supply tray to the main deck of inserter system 10 so as to be nested with the aforesaid sheet collation being conveyed along the main deck. The sheet collation, along with the nested insert(s) are next conveyed into the present invention envelope insertion station 100 that is operative to first open the envelope and then insert the collation into the open envelope. The envelope is then preferably conveyed to postage station 22 that applies appropriate postage thereto. Finally, the envelope is preferably conveyed to sorting station 24 that sorts the envelopes in accordance with postal discount requirements.

As previously mentioned, inserter system 10 includes a control system 14 coupled to each modular component of inserter system 10, which control system 14 controls and harmonizes operation of the various modular components implemented in inserter system 10. Preferably, control system 14 uses an Optical Character Reader (OCR) for reading the code from each coded document. Such a control system is well known in the art and since it forms no part of the present invention, it is not described in detail in order not to obscure the present invention. Similarly, since none of the other above-mentioned modular components (namely: input system 12, folding station 16, transport station 18, insert feeder station 20, postage station 22 and sorting station 24) form no part of the present invention insertion station 100, further discussion of each of these stations is also not described in detail in order not to obscure the present invention. Moreover, it is to be appreciated that the depicted embodiment of inserter system 10 implementing the present invention insertion station 100 is only to be understood as an example configuration of such an inserter system 10. It is of course to be understood that such an inserter system may have many other configurations in accordance with a specific user' s needs.

Figure 2:
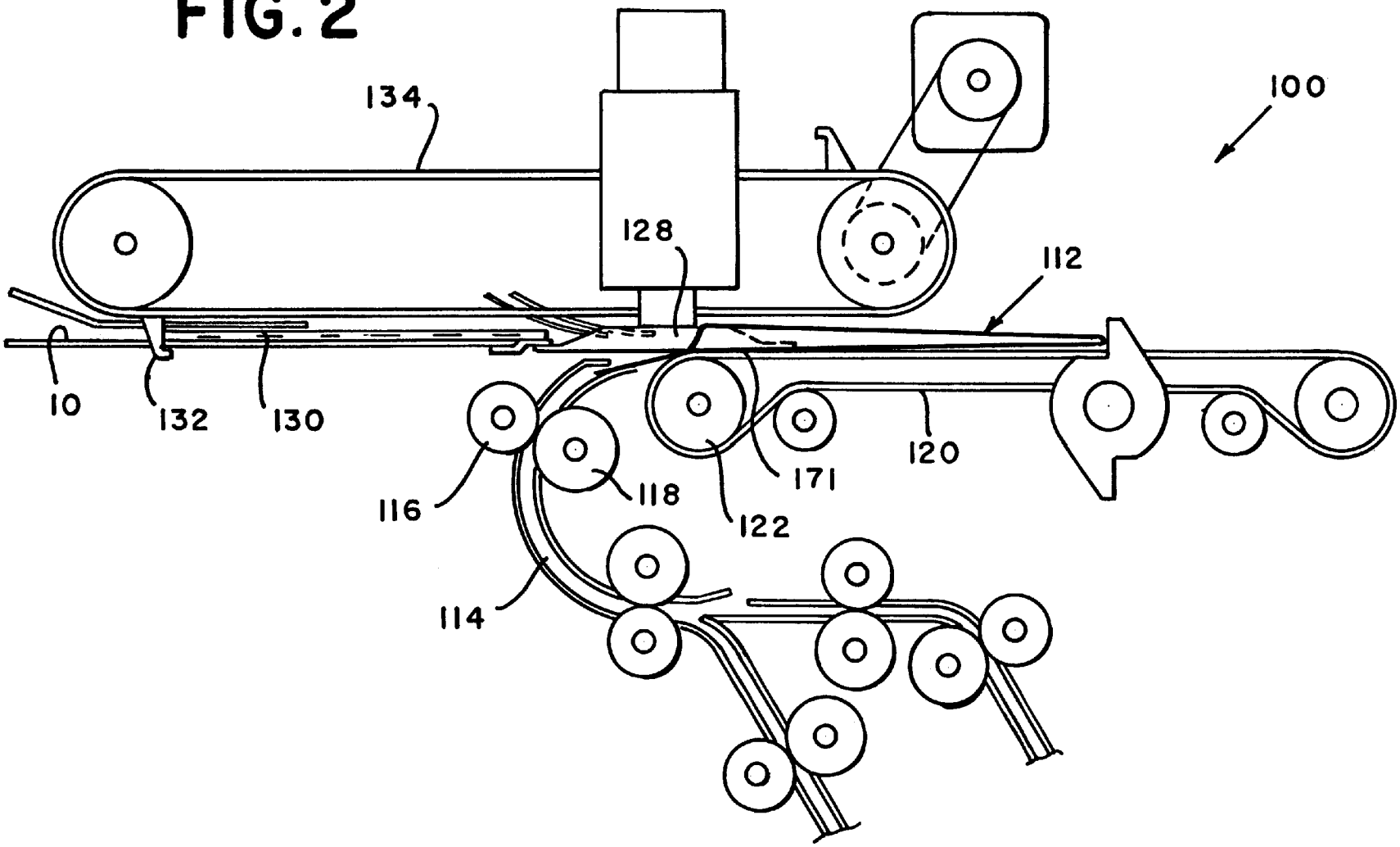
FIG. 2 is a side, elevational view of an envelope inserting apparatus using the present invention insertion horns.
Figure 3:
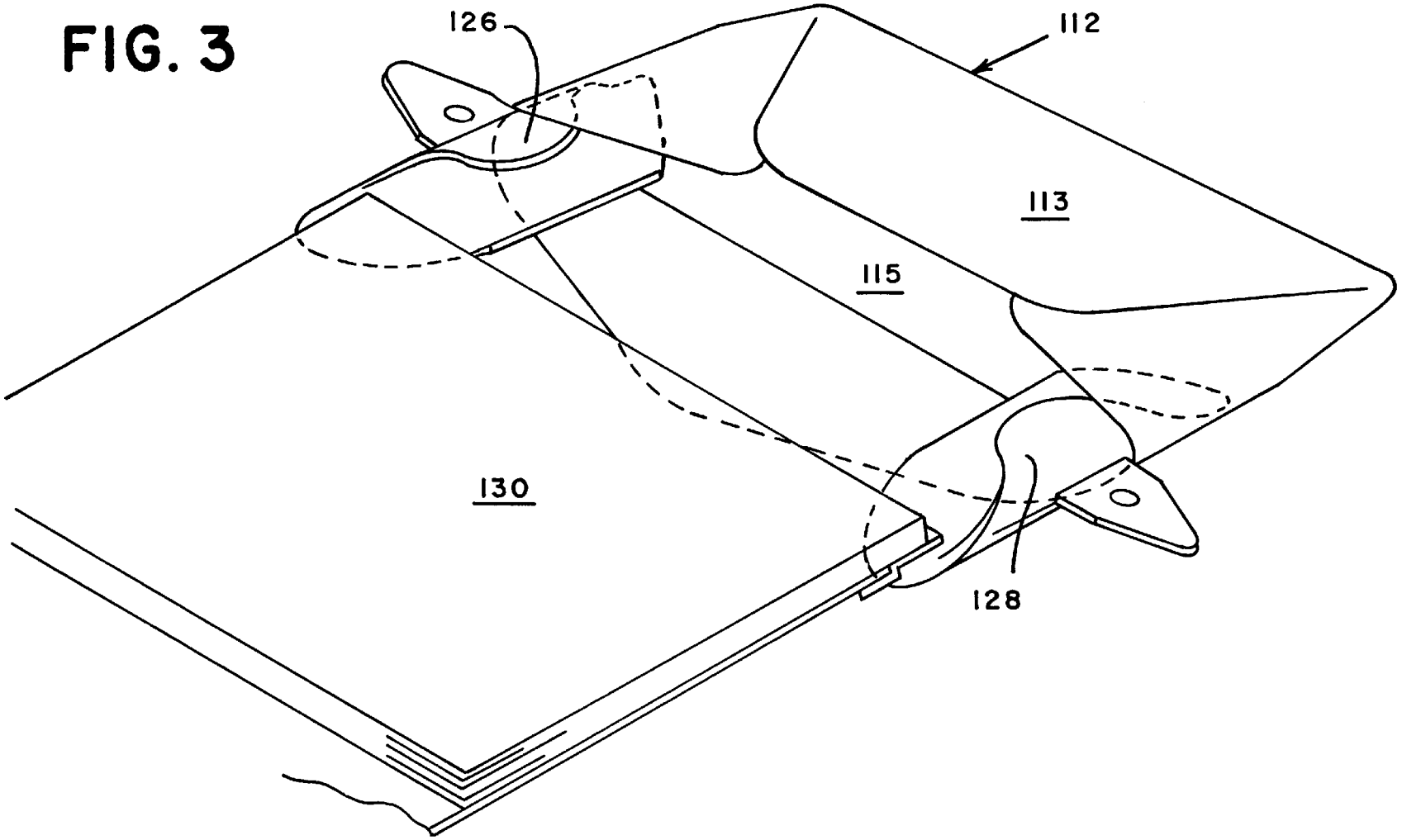
FIG. 3 is a perspective view of an envelope being opened by insertion horns seen in FIG. 2.

Referring now to FIGS. 2 and 3 the present invention insertion device 100 is shown. In operation, an envelope enters the insertion station 100 along a guide path 114 and is transported into the insertion station 100 by a set of transport rollers 116 and 118 and a transport belt 120 which wraps around a roller 122. Insertion station 100 includes envelope flap retainers 124 and 125 (FIG. 4) and insertion horns 126 and 128 each having an underside that assists in helping an envelope conform to the transport belt 120 while not presenting any catch points for the leading edge of the enclosure collation 130 to be inserted in a waiting open envelope 112.

Preferably, the enclosure collations 130 are fed into the insertion station 100 by means of a pair of overhead pusher fingers 132 extending from a pair of overhead belts 134 relative to the deck of inserter system 10. As with the envelope 112, the top side of the envelope flap retainers 124 and 125 and the associated interior of the insertion horns 126, 128 must not present any catch points for the leading edge of the enclosure collation 130.

Figure 7:
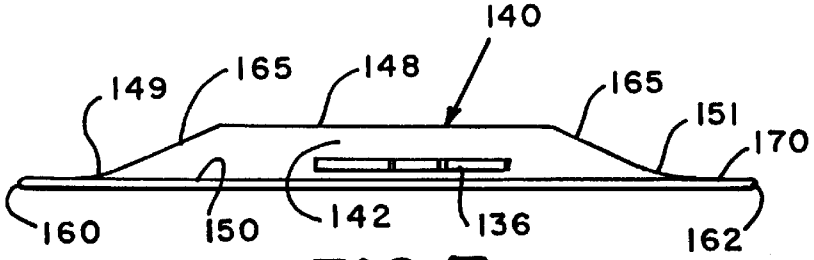
FIG. 7 is a front elevational view of the finger seen in FIG. 6.
Figure 8:
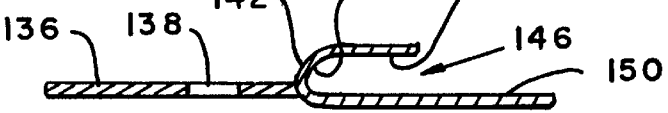
FIG. 8 is a sectional view taken on the plane indicated by the line 8—8 in FIG. 6.
Figure 6:
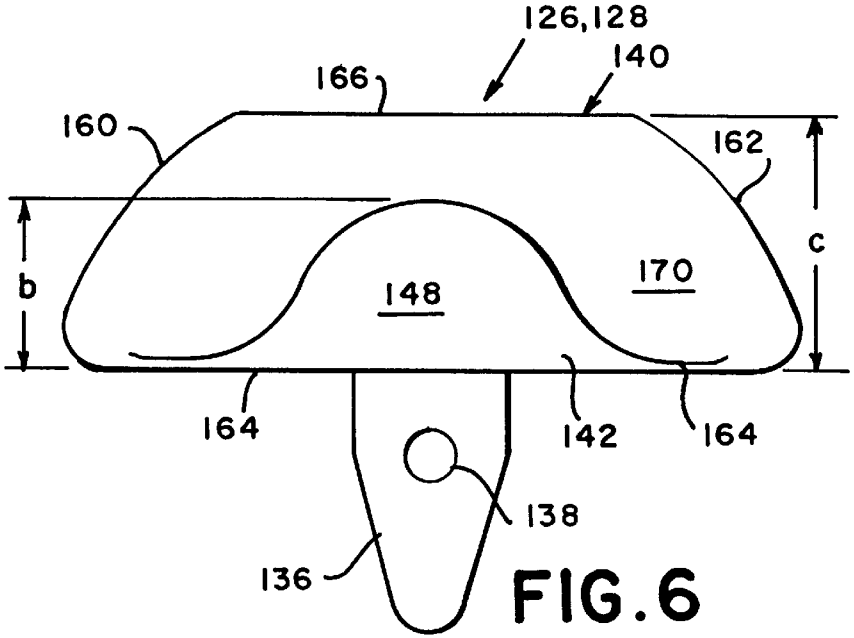
FIG. 6 is a top, plan view of the insertion horn seen in FIG. 3.

As best seen in FIGS. 6 and 7, each insertion horn 126 and 128 is identical to each other and includes an upstream end 160 and a downstream end 162 as well as first and second sides 164 and 166. More specifically, each insertion horn 126 and 128 provides a pivotable arm portion 136 having an aperture 138 that functions as a pivot point. Each arm 136 extends from a main body portion 140 and in particular from the exterior of an upwardly curved side wall 142. This upwardly curved side wall 142 defines an interior wall 144 providing a channel 146, as best seen in FIG. 8 and described in further detail below. The interior wall 144 merges into a planar top wall 148 at a top end and a planar bottom wall 150 at a bottom end of each insertion horn 126, 128. It is to be appreciated that the top wall 148 has a width (as defined by line b—b) that is less than the width of the bottom wall 150 (as defined by line c—c).

As best shown in FIGS. 6–8, the upwardly curved side wall 142 extends from an intermediate portion of the first side 164 of the bottom plate 150. The curved side wall 142 has a tapered side profile 165 that tapers from the top wall 148 toward each end region 160 and 162. As best shown in FIG. 7, the upstream 160 and downstream end 162 of each insertion horn 126 and 127 is formed with the planar bottom wall 150 that extends from the respective tapered ends 149 and 151 of the curved side wall 142 to each end 160 and 162, which planar area 170 adjacent the downstream end 162 is to be termed a "stripper blade" region. As discussed further below, the planar stripper blade region 170 of each insertion horn 126 and 128 is operative to function as a "stripper blade" when rotated into a closed envelope so as to enter into the open end of a closed envelope thereafter opening the envelope (as discussed below) without the necessity of further opening mechanisms.

As best seen in FIG. 6, the upstream 160 and downstream 162 end portion of each insertion horn 126 and 128 is shaped in a circular manner so as to avoid a surface that could stub against a conveying collation or the edge of an envelope. Furthermore, the shape of the cross-section of the interior channel 146 formed by curved side wall 142 is critical to the working of the insertion station 100 and its ability to process a range of envelope depths and enclosure thicknesses without the need for an operator to intervene to make any adjustments.

As best shown in FIG. 2, the bottom portion 171 of the stripper blade 170 of each insertion horn 126, 128 serves as a guiding surface when an envelope 112 is being transferred from the transport path 114 onto the transport belt 120 of insertion station 100. Thus, this pre-positioning of each insertion horn 126 and 128 prior to insertion of a collation 130 into an envelope 112 has the advantage of reducing the time it takes to process an envelope.

Figure 4:
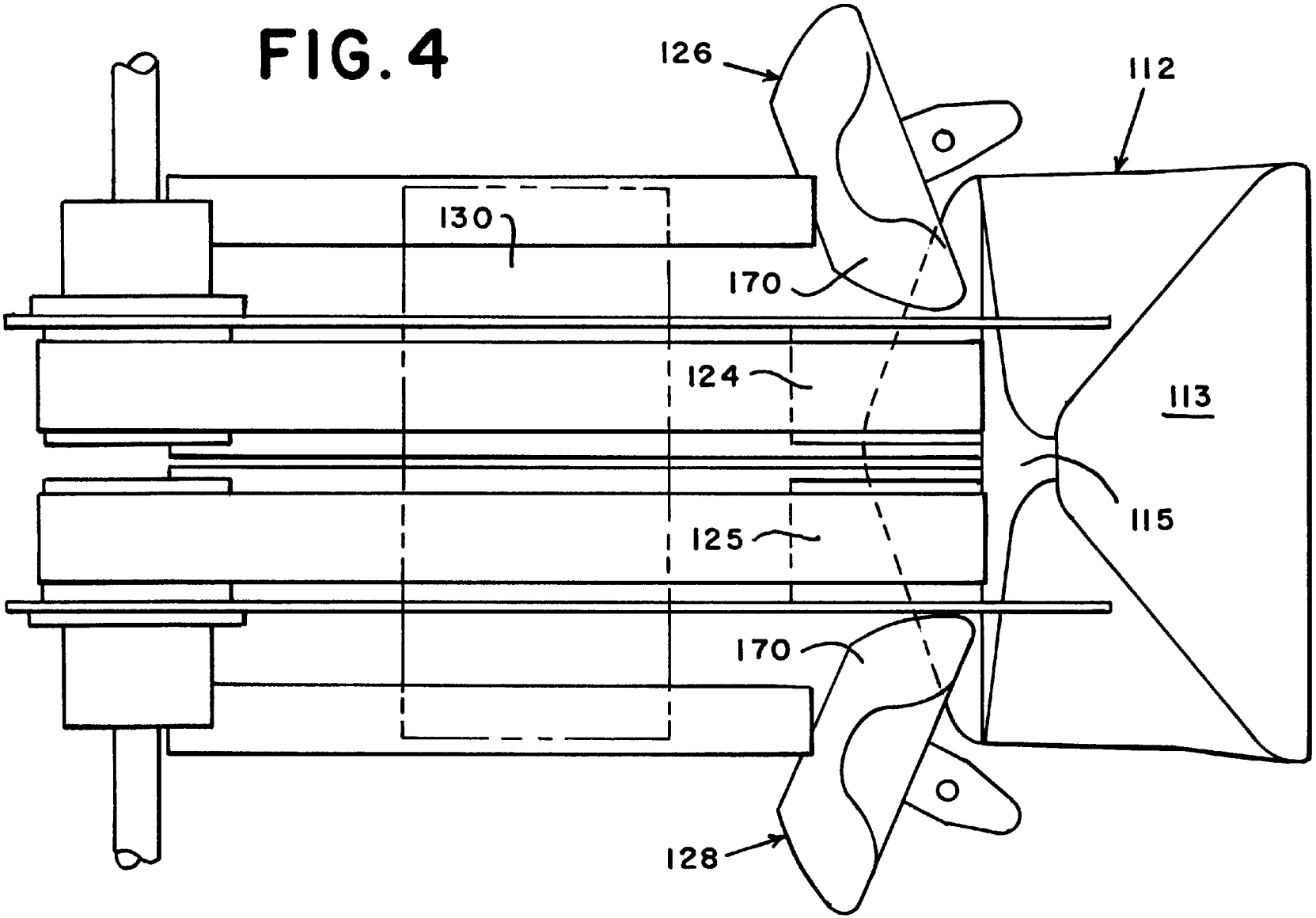
FIG. 4 is a top, plan view of the apparatus seen in FIG. 3 but shows the insertion horns about to enter the envelope.
Figure 5:
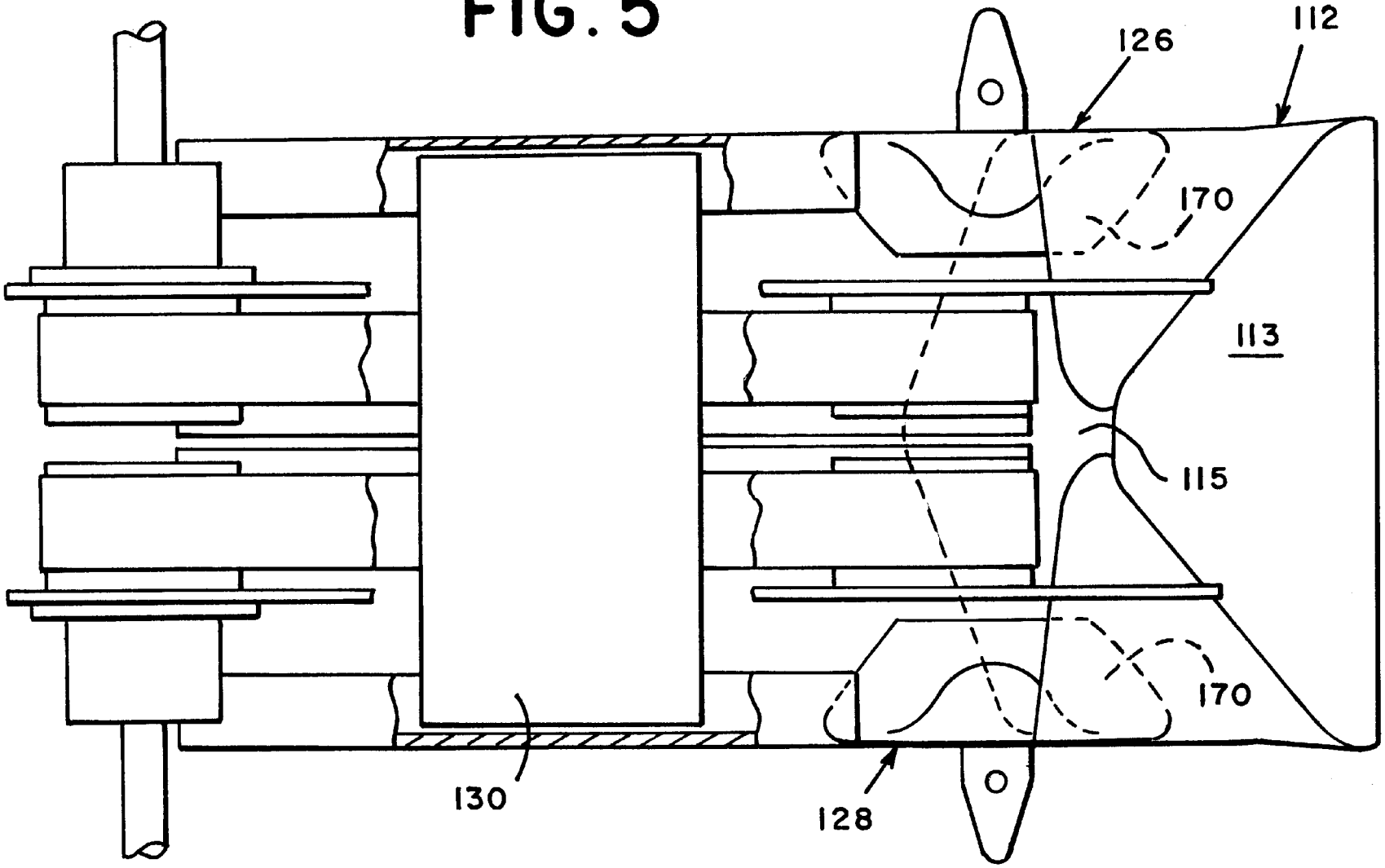
FIG. 5 is similar to FIG. 4 but shows the insertion horns within the envelope and a collation of inserts about to be inserted into the opened envelope.

With the structure of the insertion horns 126, 128 being described above, the method of operation will now be discussed in conjunction with reference to FIGS. 3–5. Referring to FIG. 4, with an envelope 112 disposed in insertion station 100, an enclosure collation 130 is conveyed by pusher fingers 132 (FIG. 2) toward envelope 112. At first, the insertion horns 126, 128 are positioned in a first position wherein their respective stripper blade portions 170 are positioned outside of the open end of the closed envelope 112. Referring now to FIGS. 5 and 6, before the conveying enclosure collation 130 is advanced into the open end of envelope 112, each insertion horn 126 and 128 is pivoted towards its second position, approximately 90°, preferably about the aperture 138 formed in each arm portion 136. When pivoted, the planar stripper blade portion 170 is first caused to enter into the open end of the closed envelope (between the opposing front and back panels of the envelope) whereafter continued pivoting the insertion horns 126, 128 into the envelope 112 causes the tapered profile 165 of each curved side wall 142 to contact the back panel of envelope 112 causing the back panel 113 to gradually separate from the front panel 115, thus opening the envelope.

Figure 9:
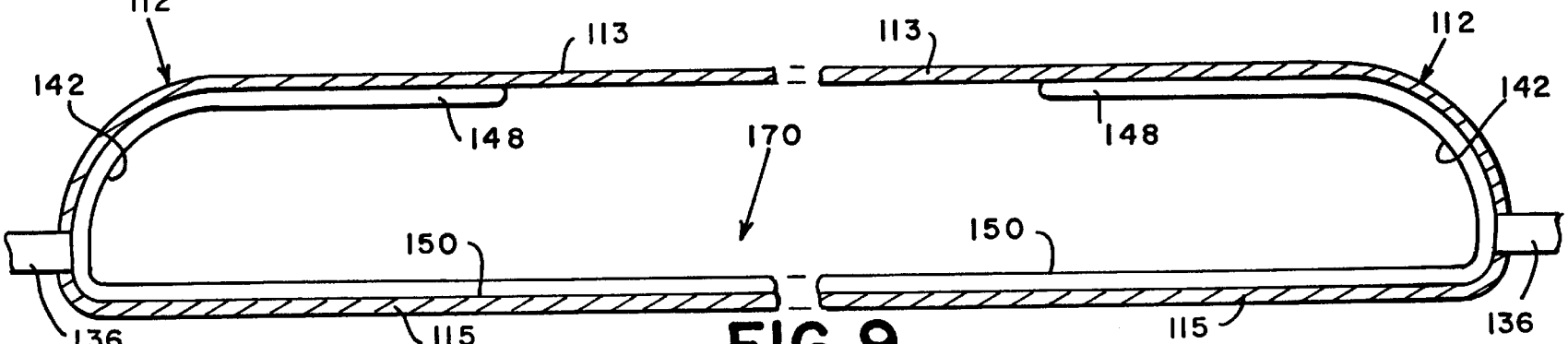
FIG. 9 is a vertical sectional view of an envelope as it is opened by the insertion horns within.

As best shown in FIG. 9, when each insertion horn 126, 128 is fully pivoted into envelope 112 in the second position, the back panel 113 of the envelope 112 is fully separated from its front panel 115 wherein the front panel 115 of envelope 112 resides below the bottom plate 150 of each insertion horn 126 and 128, and the back panel 113 of envelope 112 resides atop the top wall 148 of each insertion horn 126 and 128. An open channel 170 is thereby provided in the open end of envelope 112, which channel is defined by the channel 146 formed by the curved side walls 142 of each insertion horn 126 and 128 (FIG. 8). Thereafter enclosure collation 130 is conveyed through the open channel 170 formed in the envelope 112 so as to be inserted thereinto.

After the enclosure collation 130 is inserted into the envelope 112, the insertion horns 126 and 128 are caused to pivot, preferably 90°, back to the first position (FIG. 4) whereafter the stuffed envelope 112 is caused to advance downstream of the insertion station 100 for further processing. The above process for inserting another collation into another envelope is then repeated.

Thus, an advantage of the present invention pivoting insertion horns 126 and 128 are that they can open an envelope without the assistance of another mechanism. In other words, they can separate the back panel of an envelope from its opposing front panel at a distance that is sufficient to enable an enclosure collation to be inserted into the envelope.

In summary, an insertion station 100 for inserting an enclosure collation into an envelope in a high speed mass mailing inserter system 10 has been described. Although the present invention has been described with emphasis on a particular embodiment, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. A rotatable insertion horn for opening an envelope prior to insertion of documents into the envelope, comprising:

a planar bottom plate having an upstream end, a downstream end and first and second side portions;

a side wall upstanding from the first side portion of the planar bottom plate, the side wall having a downstream end adjacent the downstream end of the planar bottom plate and an upstream end adjacent the upstream end of the planar bottom plate wherein a portion of the planar bottom plate extends downstream from the downstream end of the side wall and upstream from the upstream end of the upstream end of the side wall; and a top planar plate extending from a top of the side wall and towards the second side of the bottom plate wherein the top plate is superposed and substantially parallel to the bottom plate.

2. A rotatable insertion horn as recited in claim 1, further including a pivotable arm extending outward from the side wall.

3. A rotatable insertion horn as recited in claim 1, wherein the upstream end of the planar bottom plate is curved.

4. A rotatable insertion horn as recited in claim 1, wherein the side wall is formed with a curved configuration.

5. A rotatable insertion horn as recited in claim 1, wherein the side wall has a tapered portion on its downstream end extending from the top wall toward the downstream end of the bottom plate.

6. A rotatable insertion horn as recited in claim 1, wherein the top plate has a width that is less than the width of the bottom plate.

7. A rotatable insertion horn as recited in claim 6, wherein the portion of the top plate that extends from the side wall is formed with a curved configuration.

8. A rotatable insertion horn as recited in claim 5, wherein the side wall has a tapered portion on its upstream end extending from the top wall toward the upstream end of the bottom plate.

9. A rotatable insertion horn for opening an envelope prior to insertion of documents into the envelope, comprising:

a planar bottom plate having an upstream end, a downstream end and first and second side portions;

a side wall upstanding from the first side portion of the planar bottom plate, the side wall having a downstream end adjacent the downstream end of the planar bottom plate and an upstream end adjacent the upstream end of the planar bottom plate wherein a portion of the planar bottom plate extends downstream from the downstream end of the side wall and the side wall further having a tapered portion on its downstream end extending from the top wall toward the downstream end of the bottom plate; and a top planar plate extending from a top of the side wall and towards the second side of the bottom plate wherein the top plate is superposed and substantially parallel to the bottom plate.

10. A rotatable insertion horn as recited in claim 9, wherein the side wall has a tapered portion on its upstream end extending from the top wall toward the upstream end of the bottom plate.

11. A rotatable insertion horn as recited in claim 9, further including a pivotable arm extending outward from the side wall.

12. A rotatable insertion horn as recited in claim 9, wherein the upstream end of the planar bottom plate is curved.

13. A rotatable insertion horn as recited in claim 9, wherein the side wall is formed with a curved configuration.

14. A rotatable insertion horn as recited in claim 9, wherein a portion of the bottom plate extends upstream from the upstream end of the side wall.

15. A rotatable insertion horn as recited in claim 10, wherein the top plate has a width that is less than the width of the bottom plate.

16. A rotatable insertion horn as recited in claim 15, wherein the portion of the top plate that extends from the side wall is formed with a curved configuration.

* * * * *